US005655383A

United States Patent [19]

Ferzoco

[11] Patent Number: 5,655,383

[45] Date of Patent: Aug. 12, 1997

[54] APPARATUS FOR DISSIPATING FOG WITH LIMITED USE OF ENERGY

[76] Inventor: Ezio Ferzoco, Piazza Corfinio No. 9, 67030 Corfinio, (L'Aguila), Italy

[21] Appl. No.: 536,967

[22] Filed: Sep. 29, 1995

[51] Int. Cl.[6] ..... F25B 47/00

[52] U.S. Cl. ..... 62/277; 62/434; 62/272

[58] Field of Search ..... 62/272, 275, 276, 62/277, 278, 279, 430, 434, 435, 150, 151, 152

[56] References Cited

U.S. PATENT DOCUMENTS 2,783,616 3/1957 Dodge ..... 62/277

5,369,961 12/1994 Seiler ..... 62/277

*Primary Examiner*—John M. Sollecito

*Attorney, Agent, or Firm*—Cesari and McKenna

[57] ABSTRACT

Apparatus for dissipating fog with limited use of energy that is especially suitable for airport runways, roads, stadiums and similar spaces. The apparatus consists of an operating system which includes a refrigerator compressor unit with defrost equipment to eliminate the formation of ice, a liquid-type condenser, an air-type condenser, a liquid type evaporator, a primary fan and twin heat exchange units, which work alternately, connected to a primary fan which supplies them with the air, that after having been dehumidified, is ejected into a diffusion/distribution system suitable for supplying a well-defined air space.

5 Claims, 4 Drawing Sheets

APPARATUS FOR DISSIPATING FOG WITH LIMITED USE OF ENERGY

FIELD OF THE INVENTION

This invention relates to apparatus for dissipating fog. It relates more particularly to such apparatus for accomplishing this objective with a minimum consumption of energy.

BACKGROUND OF THE INVENTION

Fog is a particular meteorological status of air with a high degree of humidity, an almost total absence of wind and with a condition of thermic inversion being near 0° C. near ground level, with consequential crystallization of water micro-droplets. Under these conditions, the fog phenomenon is produced and visibility is severely reduced. Fog conditions are especially hazardous on vias such as roadways and airport runways. They are also objectionable in closed densely populated buildings such as sports arenas.

By eliminating one or another of the above factors, the fog phenomenon may be interrupted and the quickest and most economically convenient way to do this is to replace humid air with "dry" air in the effected air space.

SUMMARY OF THE INVENTION

Accordingly, it is an object of this invention to provide improved apparatus for dissipating fog in an affected air space.

Another object is to provide such apparatus which requires a minimum of energy input.

A further object of the invention is to provide fog dissipation apparatus which can perform its defogging function without appreciably affecting the temperature of the ambient air in the space being treated.

Other objects will, in part, be obvious and will, in part, appear hereinafter.

The invention accordingly comprises the apparatus embodying the features of construction, combination of elements and arrangement of parts which are exemplified in the detailed disclosure set forth hereinafter, and the scope of the invention will be indicated in the claims.

In accordance with the invention, apparatus is provided which sucks in outside air and dehumidifies it by means of freezing the water particles contained in the air. This is done through a progressive reduction in the temperature of the introduced humid air which, after treatment by the apparatus, is brought back to its initial temperature and re-introduced into the atmosphere. This procedure makes it possible to de-humidify a relatively large air mass utilizing a relatively small amount of energy.

To this end, the apparatus includes twin heat exchange units connected in parallel and operated in tandem. Each heat exchange unit comprises five heat exchangers subdivided into three sections, plus circulation pumps for the liquid in the heat exchangers and control valves which regulate fluid flow through the heat exchangers. The twin heat exchange units are connected to a primary fan which conveys humid air from the space being defogged through the heat exchangers so that dry air is delivered from the heat exchange units back into the space via a suitable distribution/diffusion system at substantially the same temperature as the incoming or ambient air.

The two heat exchange units are served by a common freezing/defrosting unit which comprises a refrigerator compressor, liquid-type condenser immersed in a liquid anti-freeze bath, an air-type condenser and a liquid-type evaporator emersed in a liquid anti-freeze bath. The freezing/defrosting unit operates to warm one of the heat exchange units while cooling the other heat exchange unit, and vice versa. The flow of the de-humidified air into the surrounding atmosphere creates around the distribution/diffusion system, corridors of full visibility in the fog mass.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
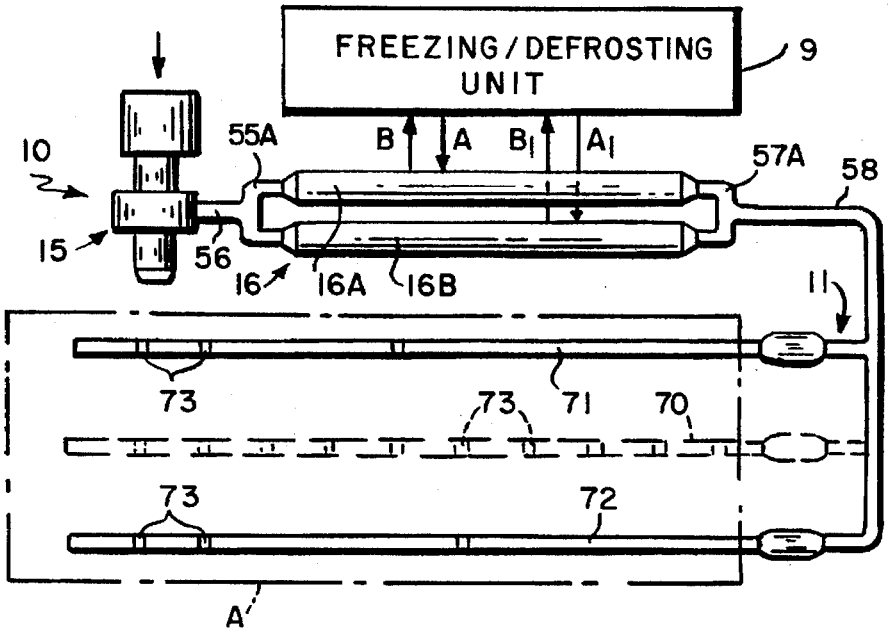
FIG. 1 is a diagrammatic view of fog dissipating apparatus incorporating the invention and including an air distribution/diffusion system suitable for an airport runway.

Referring to FIG. 1 of the drawings, apparatus shown generally at 10 is positioned to dissipate the fog above an airport runway A. The apparatus draws in ambient humid air at one, herein the left end, and delivers de-humidified or dry air at essentially the same temperature from its opposite end to a distribution/diffusion system 11 which extends along the runway A so that the dry air displaces the humid air over the runway thereby creating a fog free corridor over the runway.

Apparatus 10 includes a primary fan 15 which sucks in ambient humid air and delivers it to a heat exchange assembly 16 composed of twin heat exchange units 16A and 16B which are connected in parallel and alternately de-humidify the air delivered to the heat exchange assembly. The de-humidified air from the heat exchange assembly 16 is then routed to the distribution/diffusion system 11 for re-introduction back into the air space being conditioned.

The heat exchange units 16A and 16B are connected to a common freezing/defrosting unit 9 which shall be described in greater detail later. The unit 9 controls the heat exchange units 16A and 16B so that they work alternately to freeze the humidity contained in the air entering the heat exchange assembly 16 by progressively cooling toward the freezing temperature of water and then progressively warming toward the external (ambient) air temperature so that assembly 16 delivers dry air at the ambient temperature. The freezing/defrosting unit 9 basically causes the heat exchange assembly 16 to freeze the water contained in the incoming humid air in one heat exchange unit 16A, 16B and to simultaneously cause the other heat exchange unit 16B, 16A to defrost the ice produced during the previous cycle. Thus, the two heat exchange units 16A and 16B are operated in tandem such that the apparatus 10 produces a continuous output of dry air at essentially the same temperature as the incoming humid air.

Figure 2:
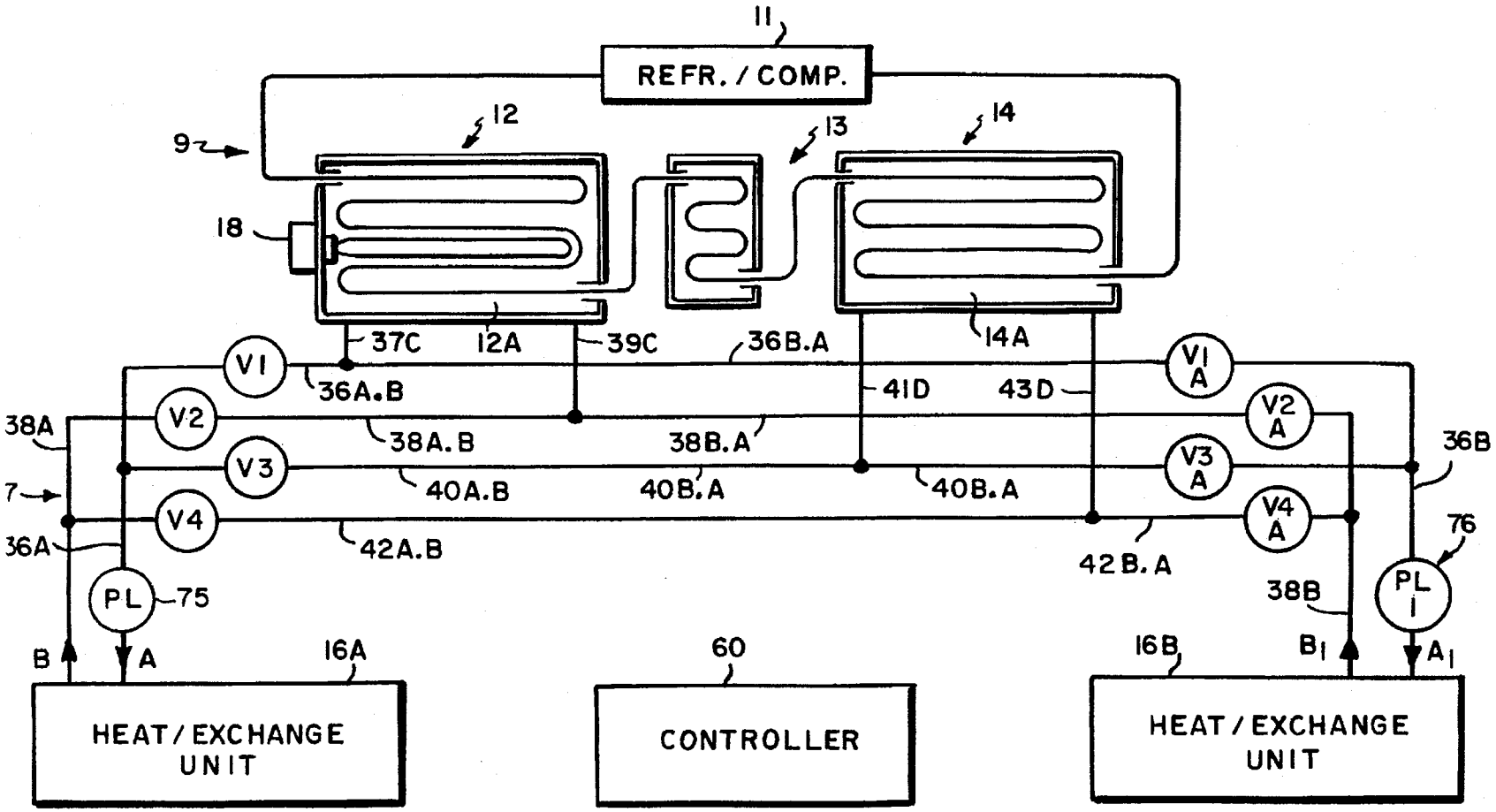
FIG. 2 is a similar view illustrating the freezing/defrosting unit of the FIG. 1 apparatus.

Referring now to FIG. 2, the freezing/defrosting unit 9 comprises a liquid-type condenser 12 and a liquid-type evaporator 14 connected to opposite sides of a refrigerator compressor 11, while an air-type condenser 13 is connected between condenser 12 and evaporator 14. Condenser 12 is immersed in a liquid anti-freeze bath 12A which includes an electric heater 18 for reasons that will become apparent. Also, evaporator 14 is immersed in a liquid anti-freeze bath 14A. As shown in FIG. 2, condenser 12 and evaporator 14 are connected to the heat exchange units 16A and 16B via a fluid distribution system shown generally at 17 in that figure.

Figure 3:
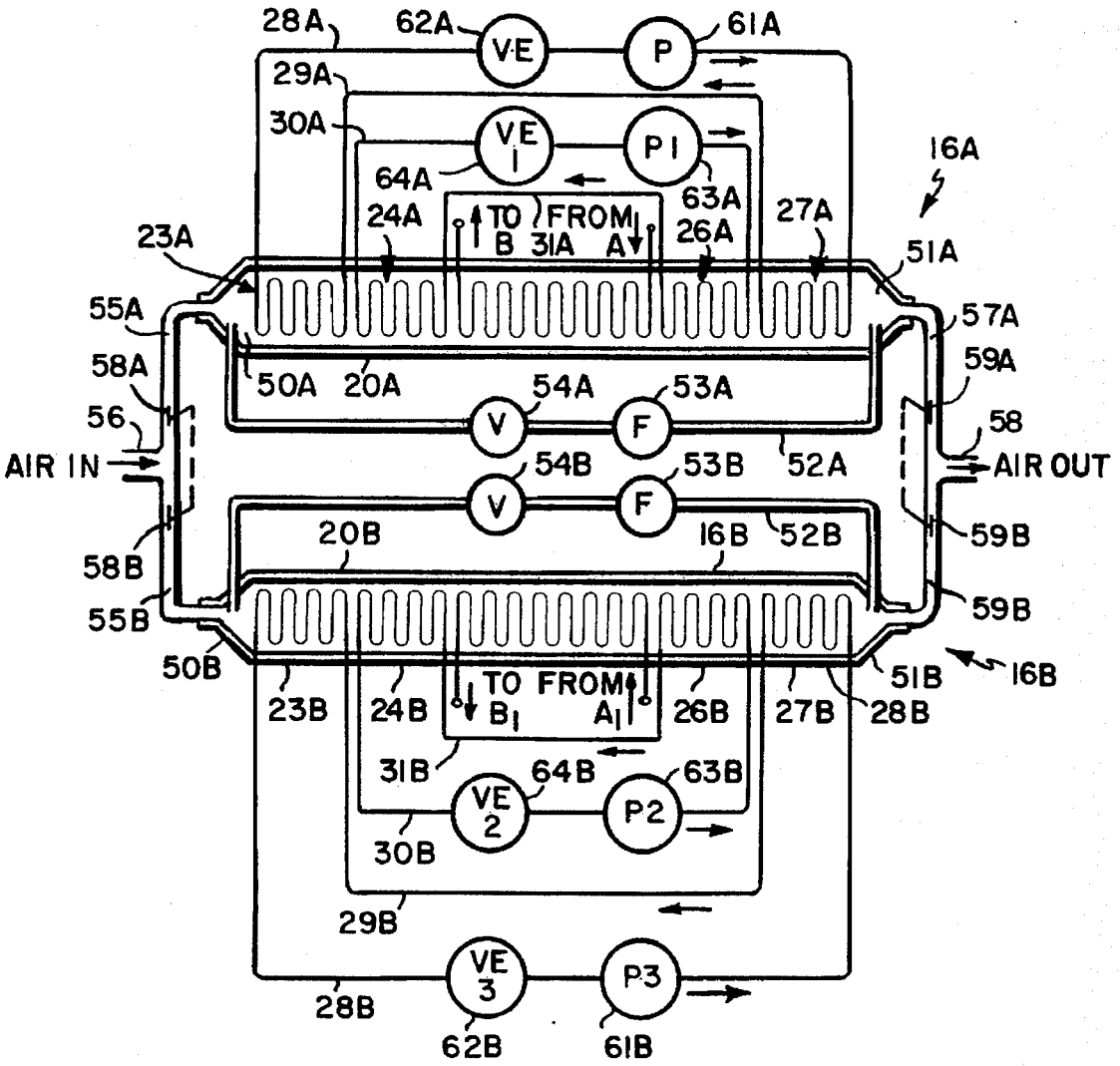
FIG. 3 is a diagrammatic view showing the twin heat exchange unit comprising the FIG. 1 apparatus.

Referring now to FIG. 3, as mentioned above, the heat exchange units 16A and 16B are substantially identical. Therefore, only unit 16A will be described in detail. All of the components illustrated in unit 16B of FIG. 3 carry the same reference numbers adopted for the description of unit 16A, but identified with the letter B.

As clearly shown in FIG. 3, heat exchange unit 16A has a tubular external body 20A having an intake 55A at its left end for the humid air and an exhaust 57A at its right end for the de-humidified air. In the tubular body 20A are found five heat exchangers indicated by the references 23A, 24A, 25A, 26A and 27A. The pairs of heat exchangers 23A–27A and 24A–26A are connected to each other through pipes 28A–29A and 30A–31A, respectively.

The single central heat exchanger 25A is connected to the anti-freeze bath 12A of the liquid-type condenser 12 in the freezing/defrosting unit 9 (FIG. 2) through pipes 36A—36A.B-37C and 38A—38A.B-39C that am intercepted by valves V1 and V2, respectively. Heat exchanger 25A is also connected to the anti-freeze bath of the liquid-type evaporator 14 through pipes 36A–40A.B-41D and 38A–42A.B-43D that are intercepted by valves V3 and V4, respectively.

As shown, the bath 12A of the liquid condenser 12 in FIG. 2 is also connected to the single central heat exchanger 25B of heat exchange unit 16B in FIG. 3 through pipes 37C–36B.A-36B and 39C–38B.A-38B that are intercepted by valves V1A and V2A, respectively.

The liquid-type evaporator 14 is also connected to heat exchanger 25B through pipes 41D–40B.A-36B and 43D–42B.A-38B that are intercepted by valves V3A and V4A, respectively.

As shown in FIG. 3, the entrance zone 50A and the exit zone 51A of heat exchange unit 16A are linked by a pipe 52A in which a fan 53A and a control valve 54A are installed.

Unit 16B is structured in the same manner, with pipe 52B linking entrance zone 50B to exit zone 51B and containing a fan 53B and a control valve 54B.

The entrance zones 50A and 50B of the twin heat exchange units 16A and 16B are connected through pipes 55A and 55B to the main humid air intake 56 of heat exchange assembly 16 which leads to the primary fan 15 (FIG. 1).

The exit zones 51A and 51B are connected through pipes 57A and 57B to the main exhaust pipe 58 of heat exchange assembly 16 where the de-humidified or dry air arrives to be conducted to the distribution/diffusion system 11 (FIG. 1 ).

As shown in FIG. 3, a control valve 58A is installed inside pipe 55A and a similar control valve 58B is installed in pipe 55B, the two valves being operated in such a way that when the first one is open, the second one is closed, and vice versa.

In the same way, two similarly operated control valves 59A and 59B are installed in pipes 57A and 57B, respectively.

Apparatus 10 includes a programmable controller 60 (FIG. 2) which produces the requisite output signals to properly control the various described fans, valves, pumps and heater to enable the system to function as will now be described.

During operation of the apparatus 10, let us suppose that heat exchange unit 16B has already completed its cycle and therefore, as will be appreciated from the following description, that unit 16B is full of ice in its central section where the heat exchanger 25B has frozen the water vapor in the humid air conveyed to that section. In this situation, the humid ambient air drawn into the apparatus by primary fan 15 will now be sent to the heat exchange unit 16A through pipe 56 and sub-pipe 55A since control valve 58B is closed at this time. This progressively colder humid air proceeds along the tubular body 20A of heat exchange unit 16A, going in sequence through heat exchangers 23A, 24A and 25A.

Heat exchanger 23A will be at the temperature of the humid air that goes through it. Let us suppose that this temperature is 30° C.; heat exchanger 27A will be at the same temperature since the two mentioned heat exchangers are linked by pipe 28A (in which pump 61A and expansion chamber 62A are interposed) and pipe 29A. The air passing through heat exchanger 24A then proceeds directly toward heat exchanger 25A which, since valves V3 and V4 are open and valves V1, V2, V3A and V4A are closed, is connected to the bath 14A of the liquid-type evaporator 14 through complex piping 41D, 40A. B, 36A and complex piping 43D, 42A. B, 38A, the liquid anti-freeze in the bath 14A being pumped by pump 75.

Therefore, when the refrigeration fluid utilized by evaporator 14 is pumped by pump 75 from refrigerator compressor 11 to heat exchanger 25A, it is brought to a temperature lower than 0° C., thereby causing the freezing of water particles contained in the mass of air passing through the heat exchange unit and leaving the formed ice on all of the coils of the heat exchanger 25A and on the first coils of heat exchangers 24A and 26A. Now, the dry air proceeds through the end zone 51A of heat exchange unit 16A, passing through heat exchangers 26A and 27A which, as already disclosed, are linked to heat exchangers 24A and 23A through pipes 30A, 31A and 28A, 29A, respectively.

The anti-freeze liquid circulating between heat exchangers 26A and 24A is pumped by pump 61A and enters chamber 62A as the anti-freeze liquid circulating between heat exchange units 27A and 23A is pumped by pump 63A and enters chamber 64A.

As already mentioned, the same explanation is applicable to heat exchange unit 16B, in which all of the components are indicated by the same reference numerals with the letter B instead of A following each part number.

Thus, it is by the above disclosed special configuration of apparatus 10 that humid air taken to a temperature lower than 0° C. and deprived of humidity undergoes a progressive process of temperature increase to 30° C. in the area of heat exchanger 27A.

The now de-humidified air brought back to the entry temperature of about 30° C. is then conveyed via exhaust pipe 57A and common exhaust pipe 58 to the distribution/diffusion system 11 as shown in FIG. 1.

Figure 4A:
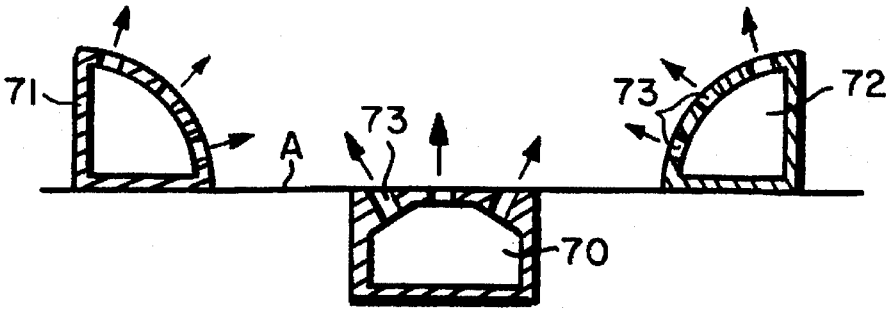
FIG. 4A is a sectional view showing in greater detail the distribution/diffusion system in the FIG. 1 apparatus.

In the installation depicted in FIG. 1, the distribution/diffusion system 11 comprises a plurality of pipes or ducts 70, 71 and 72 which are shown in greater detail in FIG. 4A. Duct 70 extends along the runway A under the runway surface, while the ducts 71 and 72 are located on opposite sides of the runway. The de-humidified air is blown out through grates 73 on the ducts and displaces the mass of humid air above the runway creating in the fog a "corridor" of dry air which greatly improves visibility for pilots taking off from or landing on the runway.

While the heat exchange unit 16A is in its phase of de-humidification as described above, unit 16B is in a de-frosting phase which will now be described.

At the moment, unit 16A started its de-humidification phase, the unit 16B heat exchanger 25B is loaded with ice formed during its own previous de-humidification phase. It is now connected to the anti-freeze bath 12A of condenser 12 through pipe complex 36B, 36B.A, 37C and pipe complex 38B,38B.A, 39C since valves V1A and V2A are open and valves V1, V2, V3A and V4A are closed at this time. The circulation inside heat exchanger 25B of the liquid coming from the warm bath 12A of condenser 12 due to pump 76 will cause the melting of the ice previously accumulated in that heat exchanger. This will flow as water to the bottom of heat exchange unit 16B where valve controlled-drain ports (not shown) are installed to discharge such water accumulation.

During this phase, it is possible that the temperature of evaporator 14 may be sufficiently low and that therefore refrigerator compressor 11 will stop functioning, thereby interrupting the warming action in condenser 12.

In such case, the warming action of the liquid coming from the bath 12A of condenser 12 may not be sufficient. When and if this condition should occur, special sensors (not shown) deliver signals to controller 60 which will then activate heater 18 to provide the necessary warming action for the anti-freeze bath 12A, thus warming the liquid routed to heat exchanger 25B. The same or other sensors (not shown) may be provided to detect a possible overheating condition in the bath 12A of condenser 12. This could occur when the condenser has excessive available heat for its intended defrosting function. In this case, the refrigeration fluid passing through the condensers serpentine coil, having arrived from compressor 11, will have to be cooled. This is done by the air-type condenser 13 that will be activated by controller 60 in response to signals from the sensors, i.e., the controller turns on the fans of the condenser.

It is important to note that in this phase of the process, the action of fan 53B which, since control valve 54B is open, will produce adequate air circulation from entrance end zone 50B to exit end zone 51B of heat exchange unit 16B, thereby favoring the de-frosting of all components in unit 16B.

As de-frosting is completed, heat exchange unit 16B is now ready for a new de-humidification cycle.

When heat exchanger 25A in heat exchange unit 16A accumulates a deposit of ice such that it significantly reduces the flow of air through that unit, special sensors (not shown) may be provided to cause controller 60 to produce a cycle inversion by commanding the opening and closing of the appropriate valves in the apparatus, thereby initiating a de-frosting cycle of heat exchanger 25A, as well as a new de-humidification cycle of heat exchange unit 16B, beginning with a freezing phase of the humid air which is now being sent to it.

Figure 5:
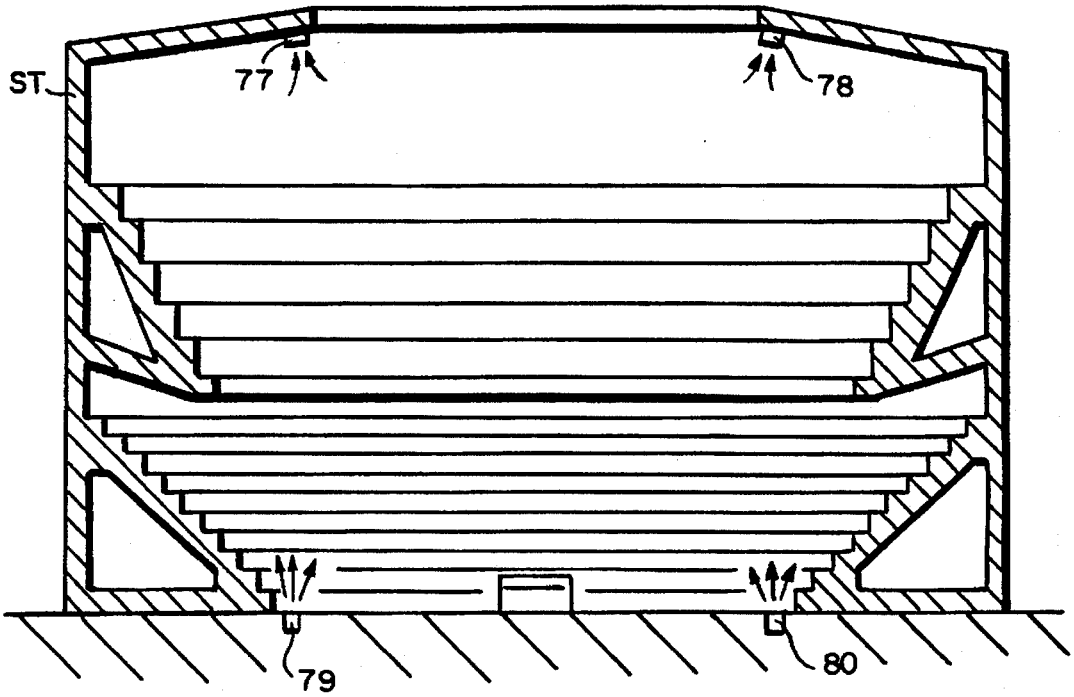
FIG. 5 is a sectional view on a much larger scale showing the FIG. 4B distribution/diffusion system installed in a typical arena or stadium.
Figure 4B:
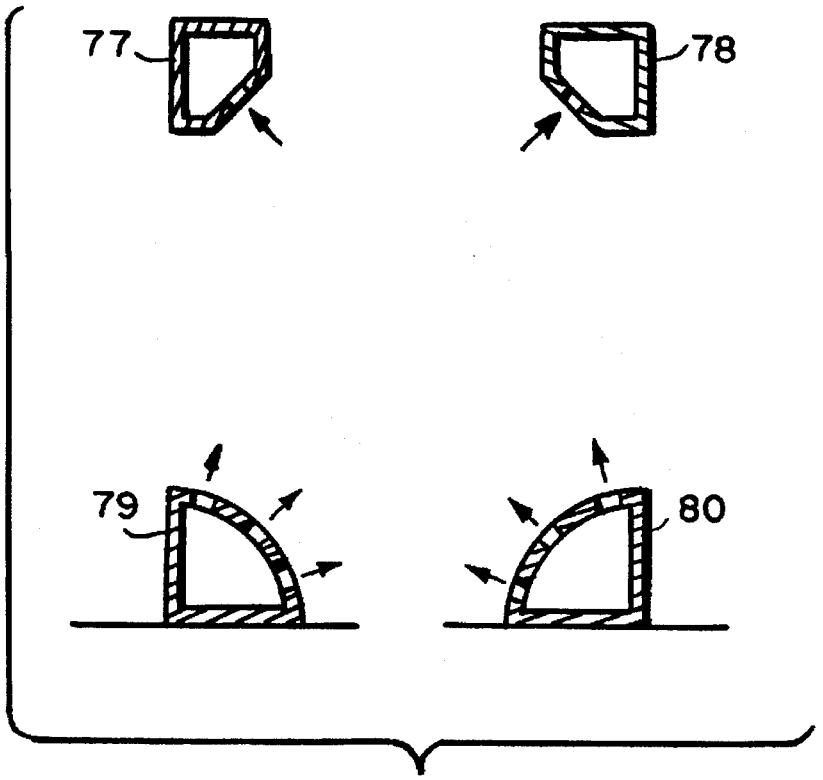
FIG. 4B is a similar view illustrating a distribution system suitable for use in a closed space such as a sports arena.

Refer now to FIGS. 4B and 5 which show a distribution/diffusion system 11 for apparatus 10 which is arranged and adapted to dissipate fog in a closed building such as a sports stadium ST. The humid air is ingested through intake ports located in pipes 77 and 78 at the highest points in the stadium from where the air is sent to apparatus 10. After being de-humidified by apparatus 10, the air is routed to distribution and diffusion pipes 79 and 80 located at the lowest points in the stadium. The dry air issuing from the pipes 79 and 80 is pushed toward the mass of fog in the stadium, thereby eliminating the fog.

Additional sensors may be utilized in the apparatus 10, such as an air pressure switch (not shown) for each heat exchange unit 16A and 16B which, being installed on the intake zones 50A, 50B of the respective tubular bodies 20A and 20B, can detect the air pressure increase of the air mass pumped there by fan 15 caused by tubular body 20A or 20B being significantly obstructed by ice. In response to signals from those sensors, controller 60 may cause apparatus 10 to undergo a previously described cycle inversion of the heat exchange units 16A and 16B.

From the foregoing description, it is apparent that apparatus 10 provides a very efficient, and therefore very economical, way to eliminate fog in precisely defined zones or spaces. Furthermore, this can be accomplished by delivering de-humidified air at the same temperature of the humid air being removed from the zone or space thus avoiding any possibility of generating unwanted thermal/atmospheric phenomena.

It will thus be seen that the objects set forth above, among those made apparent from the preceding description, are efficiently attained. Also, since certain changes may be made in the above construction with departing from the scope of the invention, it is intended that matter contained in the above description or shown in the accompanying drawings shall be interpreted as illustrative and not in a limiting sense.

What is claimed is:

1. Apparatus for dissipating fog in an air space, said apparatus comprising a liquid-type condenser, an air-type condenser, a liquid-type evaporator, a primary fan and twin dehumidifying units including freezers and which are provided with means for working alternately and are connected to the primary fan which supplies them with air, that, after having been dehumidified, is ejected from the dehumidifying units into a diffusion/distribution system fluidly connected to said dehumidifying units for dissipating the fog in a well defined operating zone of said air space, and a refrigerator compressor with defrost equipment in order to eliminate ice formations in said dehumidifying units.

2. The apparatus according to claim 1, in which each one of said dehumidifying units ejects dehumidified air at the same temperature as the air in said air space purposely to avoid unwanted thermal/atmospheric phenomena in said air space and said apparatus includes thermic exchangers which, installed before and after the freezers in the dehumidifying units respectively decrease the temperatures of the air passing through said units and then increase said temperatures before distributing dry air to said air space.

3. The apparatus defined in claim 2, in which said freezers are constituted by a heat exchanger in each dehumidifying unit connected to said liquid-type evaporator and said thermic exchangers are constituted by at least one single heat exchanger installed before, and at least one single heat exchanger installed after each said freezer, each before-installed heat exchanger being connected to a corresponding after-installed heat exchanger with the interposition of pumping means for liquid circulation from one to the other.

4. The apparatus defined in claim 3, in which the heat exchange units are connected to a common conduit for transmission of humid air to a common pipe for the diffusion of dehumidified air with the air space.

5. The apparatus defined in claim 3, in which the freezer of each heat exchange unit is connected to said liquid-type condenser in order to produce defrosting of the corresponding heat exchange unit.

* * * * *